US010405573B2

(12) United States Patent
Pesendorfer et al.

(10) Patent No.: US 10,405,573 B2
(45) Date of Patent: Sep. 10, 2019

(54) CIGARETTE PAPER WITH HIGH SHORT-FIBER FRACTION

(71) Applicant: delfortgroup AG, Traun (AT)

(72) Inventors: Kannika Pesendorfer, Salzburg (AT); Karin Sjöström, Varberg (SE); Dietmar Volgger, Gnadenwald (AT); Rainer Fantur, Innsbruck (AT)

(73) Assignee: delfortgroup AG, Traun (AT)

( * ) Notice: Subject to any disclaimer, the term of this patent is extended or adjusted under 35 U.S.C. 154(b) by 0 days.

(21) Appl. No.: 15/567,100

(22) PCT Filed: Apr. 7, 2016

(86) PCT No.: PCT/EP2016/057648

§ 371 (c)(1),
(2) Date: Oct. 17, 2017

(87) PCT Pub. No.: WO2016/166012

PCT Pub. Date: Oct. 20, 2016

(65) Prior Publication Data

US 2018/0092397 A1 Apr. 5, 2018

(30) Foreign Application Priority Data

Apr. 17, 2015 (DE) ..... 10 2015 105 882

(51) Int. Cl.
*A24D 1/02* (2006.01)
*D21H 27/00* (2006.01)
*A24C 5/00* (2006.01)

(52) U.S. Cl.
CPC ..... *A24D 1/027* (2013.01); *A24C 5/005* (2013.01); *A24D 1/02* (2013.01); *D21H 27/00* (2013.01)

(58) Field of Classification Search
CPC ..... A24D 1/02
See application file for complete search history.

(56) References Cited

U.S. PATENT DOCUMENTS 4,624,268 A 11/1986 Baker
4,984,589 A 1/1991 Riedesser
5,143,099 A 9/1992 Le Gars
2002/0026948 A1* 3/2002 Hampl, Jr. ..... A24D 1/02 131/365
2007/0295348 A1* 12/2007 Wanna ..... A24D 1/025 131/365
2008/0202542 A1 8/2008 Hampl
2012/0152266 A1* 6/2012 Volgger ..... A24D 1/025 131/365
2012/0227754 A1* 9/2012 Norman ..... A24D 1/025 131/365
2014/0326262 A1 11/2014 Volgger
2015/0090284 A1* 4/2015 Mohring ..... A24D 1/02 131/349
2016/0208440 A1* 7/2016 Byrd, Jr. ..... A24D 1/02
2016/0213057 A1* 7/2016 Goldoni, Jr. ..... A24C 5/005

FOREIGN PATENT DOCUMENTS

DE 145863 1/1981
WO WO-2013178492 A1 * 12/2013 ..... A24D 1/02
WO WO 2015062730 5/2015

OTHER PUBLICATIONS

International Searching Authority—EPO, International Search Report and Written Opinion, PCT/EP2016/057648; dated Jun. 9, 2016. 10 pages.

* cited by examiner

*Primary Examiner* — Eric Yaary

(74) *Attorney, Agent, or Firm* — Sunstein Kann Murphy & Timbers LLP

(57) ABSTRACT

A wrapping paper for smoking articles has a basis weight of at least 10 g/m$^2$ and at most 70 g/m$^2$ and comprises a mixture of cellulosic pulp fibers comprising at least 90% of short-fiber cellulosic pulp fibers, based on the mass of the cellulosic pulp fibers in the cellulosic pulp mixture, or comprising at least 95% of short-fiber cellulosic pulp fibers, based on the number of cellulosic pulp fibers, with at least 10% of the short-fiber cellulosic pulp fibers being ground, based on the mass of the number of cellulosic pulp fibers of the cellulosic pulp fiber mixture, and with the wrapping paper having over more than 50% of its area, preferably at least 55% of its area and especially preferably at least 60% of its area, an air permeability of at least 30 cm$^3$/(cm$^2$,min-kPa), and where the wrapping paper comprises at least one burning salt.

20 Claims, No Drawings

CIGARETTE PAPER WITH HIGH SHORT-FIBER FRACTION

CROSS-REFERENCE TO RELATED APPLICATIONS

This Application is a U.S. national stage entry under 35 USC § 371 of PCT/EP2016/057648filed Apr. 7, 2016, which claims priority to German Patent Application 10 2015 105 882.0, filed Apr. 17, 2015; both of which are incorporated herein by reference in their entireties.

FIELD OF THE INVENTION

The invention relates to a wrapping paper for smoking articles. In particular, it relates to a wrapping paper for smoking articles that, by using a high fraction of short-fiber pulp, can be produced with less energy and cost outlay than conventional wrapping papers for smoking articles, without deteriorating the essential technical properties thereby. Further, the invention relates to a smoking article that comprises the wrapping paper according to the invention.

BACKGROUND AND PRIOR ART

A typical cigarette consists of a tobacco rod, which is wrapped with a cigarette paper. In many cases, cigarettes are also equipped with a filter, typically made from cellulose acetate, which is wrapped with a filter wrapping paper and is additionally wrapped on the outside with a tipping paper, which is slightly longer than the filter and thus connects the filter to the tobacco rod wrapped with the cigarette paper. Such cigarettes are usually consumed by burning the tobacco and the smoke created thereby is inhaled by the smoker.

Alternative smoking articles do not burn the tobacco but just heat it, wherein an aerosol is released which is inhaled by the smoker. It is assumed that the aerosol of such smoking articles contains less harmful substances than the smoke of conventional cigarettes. Instead of tobacco, other aerosol-generating materials can also be used. Depending on the construction of these smoking articles, a wrapping paper can also be required for such smoking articles, which wraps the tobacco or the aerosol-generating material or other parts of the smoking article.

There are many technical requirements for a wrapping paper for smoking articles, in particular regarding the air permeability, the diffusion capacity, but also regarding optical requirements such as whiteness, color and opacity. The selection of possible raw materials for such wrapping papers is often subject to legal restrictions, for which reason the manufacturer of such wrapping papers is restricted in the design of the wrapping paper.

Apart from technical requirements for the wrapping paper, commercial considerations can also play a role in the design of the wrapping paper. The manufacture of paper in general and of wrapping papers for smoking articles in particular needs a lot of energy and, to some extent, expensive raw materials.

Wrapping papers for smoking articles typically contain pulp fibers. These pulp fibers are refined in refiners during the manufacture of the wrapping paper. This means that by mechanically loading the pulp fibers, individual fibers or fibrils of the fiber bundles are exposed. Thus, a larger surface area and more options are available to connect the individual pulp fibers to each other by hydrogen bonds during paper production. This provides the paper with tensile strength, but it also influences its air permeability. In general, more intensive refining of the pulp fibers leads to a higher tensile strength of the paper but to a lower air permeability. This refining process is energy-intensive and thus also expensive.

Pulp fibers are differentiated into long-fiber pulp, which is typically sourced from coniferous trees like spruce, pine or larch, and short-fiber pulp, which is typically sourced from deciduous trees, like beech, birch, eucalyptus, poplar or aspen. In general, long-fiber pulp is more expensive than short-fiber pulp and has to be refined with more energy outlay than short-fiber pulp. In wrapping papers for smoking articles, short-fiber pulp is generally used unrefined.

A further important kind of pulp fibers for wrapping papers for smoking articles are pulp fibers that are not sourced from trees, but for example from flax, hemp, sisal, aback jute or cotton. These pulp fibers can replace the long-fiber pulp regarding their technical effects in the wrapping paper because of their length and tensile strength, but they are even more expensive than long-fiber pulp.

A further important kind of pulp fibers for wrapping papers for smoking articles are pulp fibers that are sourced from esparto grass. These pulp fibers provide the wrapping paper with more volume and lower density and for their technical effects in the wrapping paper can be used as an alternative to short-fiber pulp.

According to the accepted teachings of the prior art, wrapping papers for smoking articles need to contain long-fiber pulp or pulp fibers with comparable technical effect, so that the wrapping paper has a sufficient tensile strength for the manual or machine production of smoking articles. The fraction of long-fiber pulp in the total pulp in wrapping papers for smoking articles is, according to the prior art, at least 20% and typically between 25% and 70%. This causes the production of wrapping papers for smoking articles to be expensive.

Because of the high and generally increasing taxes and fees with which smoking articles are burdened, there is an interest in the industry in producing the components of smoking articles more inexpensively, so that smoking articles can still be offered to the consumer at an acceptable price.

Thus, there is an interest in the industry in producing wrapping paper for smoking articles with less cost outlay for energy and raw materials.

SUMMARY OF THE INVENTION

The objective of the present invention is to provide a wrapping paper for smoking articles that can be produced with a smaller energy and cost outlay compared to conventional wrapping papers, such that the technical properties, in particular the tensile strength of the wrapping paper, do not substantially deteriorate.

The objective is achieved by means of a wrapping paper according to claim 1 and by means of a smoking article according to claim 20. Advantageous embodiments are disclosed in the dependent claims.

The wrapping paper according to the invention has a basis weight of at least 10 g/m$^2$ and at most 70 g/m$^2$ and comprises a mixture of pulp fibers. The inventors have surprisingly found that the objective can be achieved by a wrapping paper for smoking articles, of which the mixture of pulp fibers with respect to the mass of the pulp fibers in the pulp mixture is formed by at least 90% short-fiber pulp fibers or, with respect to the number of pulp fibers, by at least 95% short-fiber pulp fibers, wherein at least 10% of the short-fiber pulp fibers with respect to the mass or the number of pulp fibers of the pulp mixture are refined.

In contrast to the accepted teaching in the prior art, according to which long-fiber pulp or pulp of similar technical effect is necessarily required to achieve the needed tensile strength of the wrapping paper, the inventors have surprisingly found that a wrapping paper with suitable properties for practical applications can be produced with a very high fraction of short-fiber pulp if at least a part of the short-fiber pulp is refined. Apparently, refining a part of the short-fiber pulp causes a sufficient increase in the tensile strength of the wrapping paper, so that the use of expensive long-fiber pulp can be predominantly or totally avoided. Dispensing with long-fiber pulp in this manner can substantially reduce the costs for the pulp itself, but also for the energy outlay for refining which is normal with long-fiber pulp.

In fact, it turns out that the wrapping paper according to the invention can have a sufficient tensile strength, without a further coating to increase the tensile strength being necessary. However, the wrapping paper can also be coated in certain areas, for example to reduce the diffusion capacity and thus provide self-extinguishing properties to a cigarette manufactured from the wrapping paper. The base paper, i.e. the wrapping paper without such coating, however, has an air permeability of at least 30 $cm^3/(cm^2 \cdot min \cdot kPa)$. But even when the wrapping paper according to the invention is coated in certain areas, it has over at least 50% of its area, preferably at least 55% of its area and particularly preferably at least 60% of its area an air permeability of at least 30 $cm^3/(cm^2 \cdot min \cdot kPa)$.

Further, the wrapping paper contains at least one burn additive. This ensures that the wrapping paper according to the invention, if it is used for conventional tobacco cigarettes, provides the ash with a pleasant appearance and in this respect suffers from no disadvantages compared with conventional wrapping papers, even if the wrapping paper, as in some preferred embodiments, has a comparably low content of filler materials. In particular, the glowing cone can thus be prevented from shifting substantially under the wrapping paper, which would then generate an undesirable optical effect.

As mentioned above, the wrapping paper according to the invention can even generate sufficient tensile strength if it is not coated with an additional coating to increase the tensile strength. In a preferred embodiment, the wrapping paper is thus free of any additional coating. However, in other embodiments it can have coated areas, for example, such as those which are used for self-extinguishing purposes, but these preferably make up less than 50%, particularly preferably less than 45% and in particular less than 40% of the total surface area of the wrapping paper.

The pulp mixture in the wrapping paper is preferably designed such that its fibers have an average length of at most 2.0 mm and of at least 0.1 mm.

In a particularly preferable embodiment, the average length of the fibers in the finished wrapping paper is at most 1.5 mm and most particularly preferably at most 1.2 mm and in particular at most 1.0 mm.

The fraction of short-fiber pulp with respect to the mass of the fibers in the pulp mixture in the wrapping paper according to the invention has to be, as described above, at least 90% or with respect to the number of fibers in the pulp mixture at least 95%. However, insofar as it is allowed by the requirements as regards the tensile strength of the wrapping paper an attempt may be made to make the fraction of short-fiber pulp as high as possible, so that with respect to the mass it is preferably 95% and with respect to the mass or number particularly preferably 100%, so that essentially the entire pulp mixture is formed by short-fiber pulp. The percentages with respect to the mass or number of short-fiber pulp fibers are to be interpreted to include consideration of typical tolerances in the purity of pulps and in the manufacture of wrapping papers.

As described above, for the wrapping paper according to the invention, at least 10% of the short-fiber pulp fibers, with respect to the mass or number of the fibers in the pulp mixture, have to be refined. Since refining requires an energy outlay, the fraction of refined short-fiber pulp will be kept as low as possible. To increase the tensile strength, however, it may be advantageous to choose a higher fraction than 10%. In a preferred embodiment, the fraction of refined short-fiber pulp fibers with respect to the mass of the total pulp fibers, is at least 20%, particularly preferably at least 30% and/or at most 100%, particularly preferably at most 80%, in particular at most 70%, or with respect to the total number of pulp fibers, at least 20%, particularly preferably at least 35% and/or at most 100%, particularly preferably at most 85%, in particular at most 75%.

The effect of refining the pulp can be determined by the degree of refining in accordance with ISO 5267-1:1999 and is given in degrees Schopper-Riegler (° SR). In a preferred embodiment, the degree of refining of the refined short-fiber pulp in accordance with ISO 5267-1:1999 is at least 20° SR, particularly preferably at least 30° SR and/or at most 85° SR, particularly preferably at most 80° SR.

The skilled person can optimize the energy outlay to obtain a sufficient tensile strength in the wrapping paper, for example, by using a little, but intensively refined short-fiber pulp, or a lot but less refined short-fiber pulp.

To produce the wrapping paper on conventional paper machines, the degree of refining of the pulp mixture is of particular importance, i.e. the mixture of refined short-fiber pulp, unrefined short-fiber pulp, if present, and, optionally other pulps. The degree of refining describes the speed with which an aqueous fiber suspension can be de-watered and thus also influences, apart from the tensile strength of the wrapping paper, the maximum speed of the paper machine during production of the wrapping paper, and thus indirectly the costs of production. A low value for the degree of refining means fast de-watering of the fiber suspension and vice versa. In general, the lowest possible degree of refining of the pulp fiber mixture will be selected.

In a preferred embodiment, the degree of refining of the pulp mixture in the finished wrapping paper is at least 20° SR and particularly preferably at least 30° SR and most particularly preferably at least 40° SR and/or at most 70° SR and particularly preferably at most 60° SR.

The short-fiber pulp for the wrapping paper according to the invention can preferably be sourced from deciduous trees, preferably from birch, beech, eucalyptus, poplar or aspen and particularly preferably from birch or eucalyptus. Mixtures of short-fiber pulps of different origin can be used. The use of short-fiber pulp from esparto grass, partially or completely, is possible according to the invention, but is not preferred because of its low availability and its higher price.

Apart from short-fiber pulp, the wrapping paper according to the invention can also contain other pulps, the amount of which, as described above, may be at most 10% and preferably at most 5% with respect to the mass of pulp fibers in the pulp mixture or, with respect to the number of pulp fibers in the pulp mixture, at most 5%, preferably at most 2%.

Preferably, said other pulps can be formed by pulps sourced from coniferous trees, particularly preferably from spruce, pine or larch. Pulp fibers are also preferred which are sourced, for example, from flax, hemp, sisal, aback jute or cotton. These fibers can be used unrefined, but are preferably refined, for example to provide a particularly high strength to the wrapping paper.

It is also possible to use fibers from regenerated cellulose such as, for example, lyocell fibers such as Tencel®, viscose fibers or Modal fibers. The use of such fibers can make sense for technical reasons, however it is not preferred for the present invention because of the price of these fibers As described above, the wrapping paper for smoking articles according to the invention has a basis weight of at least 10 g/m$^2$ and at most 70 g/m$^2$. Generally, when selecting the basis weight, the skilled person will search for a balance between tensile strength, opacity and whiteness as well as costs and impact on taste. With increasing basis weight, tensile strength, opacity and whiteness will generally increase, but due to the higher mass of the wrapping paper, the impact on taste on the smoking article and the costs for materials increase. Thus, the basis weight of the wrapping paper according to the invention is preferably at least 20 g/m$^2$, particularly preferably at least 25 g/m$^2$ and/or at most 60 g/m$^2$, particularly preferably at most 40 g/m$^2$. The basis weight of the wrapping paper can be determined in accordance with ISO 536:2012.

The wrapping paper according to the invention can contain filler materials. Preferred filler materials which may be used are oxides, hydroxides, carbonates and silicates, particularly preferably oxides, hydroxides, carbonates and silicates of metals, most particularly preferably calcium carbonate, magnesium oxide, magnesium hydroxide, magnesium carbonate and aluminum hydroxide. A particularly preferable filler material is precipitated calcium carbonate because of its high purity.

Because filler materials are generally less expensive than pulp and can additionally increase opacity and whiteness of the wrapping paper, the skilled person will try to select a filler content in the wrapping paper which is as high as possible. The fillers, however, also reduce the tensile strength of the wrapping paper, and thus the skilled person should not select an arbitrarily high filler content, particularly if the fraction of refined short-fiber pulp is low.

In a preferred embodiment, the wrapping paper according to the invention contains at most 45% by weight filler material, and particularly preferably at most 40% by weight and most particularly preferably at most 35% by weight, each with respect to the weight of the wrapping paper as it is used on the smoking article.

Generally, the wrapping paper according to the invention can be produced without or with very little filler material, however, preferably, the filler content is at least 10% by weight, particularly preferably at least 15% by weight and most particularly preferably at least 20% by weight.

In particular with respect to the use on smoking articles, in which the tobacco is burnt, the wrapping paper according to the invention also contains at least one burn additive which increases or reduces the smoldering speed of the smoking article or can improve the appearance of the ash of the burnt tobacco with the burnt wrapping paper.

In a preferred embodiment, the wrapping paper thus comprises one or more burn additives selected from the group consisting of citrates, malates, tartrates, acetates, nitrates, succinates, fumarates, gluconates, glycolates, lactates, oxalates, salicylates, α-hydroxy caprylates, phosphates and hydrogen carbonates, preferably selected from the group consisting of trisodium citrate and tripotassium citrate.

The content of burn additives in the wrapping paper according to the invention is preferably at least 0.5% by weight, particularly at least 0.7% by weight, most particularly preferably at least 1.0% by weight and/or at most 7.0% by weight, particularly preferably at most 5.0% by weight and most particularly preferably 3.0% by weight. The content of burn additives can be determined, for example, for acetates in accordance with CORESTA Recommended Method No. 33 (January 1993), and with respect to anhydrous acetic acid. For citrates, the measurement can be carried out in accordance with CORESTA Recommended Method No. 34 (January 1993), wherein the content, as a % by weight, is provided with respect to the monohydrate of the citric acid. For phosphates, the content can be determined in accordance with CORESTA Recommended Method No. 45 (January 1998) and provided with respect to the phosphate ions ($PO_4^{3-}$).

Parameters particularly relevant for further processing of the wrapping paper for smoking articles are the tensile strength and the elongation at break of the wrapping paper, in particular the tensile strength and elongation at break in the machine direction. They can be determined in accordance with ISO 1924-2:2008. In this method, a strip of paper with a width of 15 mm is stretched at a constant speed until it breaks and the observed maximum force therefor is measured. This force is the tensile strength and it is given in N/15 mm. The elongation at which the break occurs is the elongation at break, and is given as a percentage with respect to the length of the paper sample without any load.

Generally, automatic processing of the wrapping paper into smoking articles requires a tensile strength in the machine direction of at least about 9 N/15 mm and an elongation at break in the machine direction of at least about 1.0%. For the manual or partially manual production of smoking articles from wrapping paper, however, lower values may also be acceptable. This also applies to the automatic production of smoking articles with a correspondingly lower production speed than the maximum possible.

Hence, a preferred wrapping paper according to the invention for smoking articles has a tensile strength in the machine direction in accordance with ISO 1924-2:2008 of at least 10 N/15 mm and particularly preferably at least 12 N/15 mm. An upper limit for the tensile strength in the machine direction is preferably 30 N/15 mm, particularly preferably 25 N/15 mm and most particularly preferably 20 N/15 mm.

A preferred wrapping paper for smoking articles according to the invention has an elongation at break in the machine direction in accordance with ISO 1924-2:2008 of at least 0.9% and particularly preferably at least 1.0%. The elongation at break in the machine direction in accordance with ISO 1924-2:2008 is preferably at most 5.0%, particularly preferably at most 3.0% and most particularly preferably at most 2.5%.

A further important property of the wrapping paper for smoking articles is its air permeability. It can be determined in accordance with ISO 2965:2009 and is provided in cm$^3$/(cm$^2$·min·kPa). The air permeability can influence the substances of the smoke or the aerosol of a smoking article, by allowing the ingress of air through the cigarette paper into the smoking article and thus replacing a fraction of the smoke or of the aerosol in the smoking article with air. In particular, the air permeability can influence the tar, nicotine and carbon monoxide content in the smoke of a cigarette.

The air permeability of known, naturally porous wrapping papers for smoking articles is typically between 10 cm$^3$/(cm$^2$·min·kPa) and 300 cm$^3$/(cm$^2$·min·kPa), wherein the air permeability can be further increased by perforation, for example up to 10000 $cm^3/(cm^2 \cdot min \cdot kPa)$. Wrapping papers with an air permeability of less than 10 $cm^3/(cm^2 \cdot min \cdot kPa)$ are also known. Such wrapping papers are primarily used for manually produced smoking articles (roll-your-own).

In many countries, the legal requirements provide upper limits for the tar, nicotine and carbon monoxide content in the smoke of a cigarette. Generally, there is a trend towards wrapping papers with higher air permeability, to replace or dilute the smoke in the smoking article with more inflowing air and thus to reduce the tar, nicotine and carbon monoxide content in the smoke.

The use of a high fraction of short-fiber pulp in the wrapping paper according to the invention allows a wrapping paper with a particularly high air permeability to be produced.

As mentioned at the beginning, the air permeability in untreated areas of the wrapping paper according to the invention is at least 30 $cm^3/(cm^2 \cdot min \cdot kPa)$, preferably at least 50 $cm^3/(cm^2 \cdot min \cdot kPa)$ and particularly preferably at least 70 $cm^3/(cm^2 \cdot min \cdot kPa)$. If the wrapping paper according to the invention has a low basis weight and the short-fiber pulp is only slightly refined, particularly high air permeabilities can be achieved. Preferably, however, the air permeability is at most 10000 $cm^3/(cm^2 \cdot in \cdot kPa)$, particularly preferably at most 5000 $cm^3/(cm^2 \cdot min \cdot kPa)$ and most particularly preferably at most 500 $cm^3/(cm^2 \cdot min \cdot kPa)$, in order to allow the tensile strength to be simultaneously advantageous for further processing, which is difficult to reconcile with extremely air permeable papers.

A further important property of the wrapping paper for smoking articles is also its diffusion capacity. The diffusion capacity determines the transport of gases through the wrapping paper caused by a concentration difference. Particularly during the consumption phases of a smoking article, in which no pressure difference exists between the two sides of the wrapping paper, gases such as carbon monoxide can diffuse through the wrapping paper. This means that, for example, the carbon monoxide content in the smoke or aerosol of a smoking article can be influenced.

The diffusion capacity of carbon dioxide into nitrogen for a wrapping paper can be measured in accordance with CORESTA Recommended Method No. 77 (April 2014) and can be given in cm/s. For naturally porous wrapping papers, there is a certain relationship between air permeability and diffusion capacity, as both parameters are determined by the porous structure of the wrapping paper. For this reason, air permeability and diffusion capacity cannot be chosen completely independently of each other.

Because a high diffusion capacity can particularly reduce the carbon monoxide content in the smoke or aerosol of a smoking article, and because carbon monoxide is toxic and does not contribute to the taste or aroma of the smoking article, there is generally a desire to choose the diffusion capacity to be as high as possible; however, the aforementioned close relationship with the air permeability has to be considered.

In a preferred embodiment of the wrapping paper for smoking articles according to the invention, the diffusion capacity in untreated areas is thus at least 0.1 cm/s, particularly preferably at least 1.0 cm/s and/or at most 5.0 cm/s, particularly preferably at most 4.0 cm/s.

The wrapping paper can have patterns that result from compression of the wrapping paper. These can, for example, be so called verge lines. In the area of these lines, the paper is compressed and thus more transparent. Verge lines can be applied in the machine direction of the wrapping paper, in the cross direction of the wrapping paper or in any other direction. Apart from a line pattern, other arbitrary patterns can also be applied.

The wrapping paper can contain watermarks in any arbitrary form.

The wrapping paper can comprise further substances which are known from the prior art for the manufacture of wrapping papers for smoking articles. This can include, for example, inorganic pigments, for example, iron oxides, or organic colorants, which endow the wrapping material with a specific color. Further, this can also include flavorings which influence the aroma or taste of the smoke or of the aerosol from the smoking article. This can be the smoke or the aerosol which the consumer of the smoking article inhales as well as the smoke or aerosol which is released by the smoking article without being inhaled by the consumer of the smoking article, in particular the side-stream smoke from a cigarette. Such flavoring can be linked to physical carriers, such as by encapsulation, for example in cyclodextrin or polymers. The flavorings can be chemically bound as well, for example in ethyl vanillin glucoside.

The wrapping paper can also have additional areas of reduced diffusion capacity that aid self-extinguishing of the smoking article, for example in order to comply with legal requirements regarding self-extinguishing. Such areas of reduced diffusion capacity can be produced in accordance with the prior art by the application of film-forming substances, but also by other processes such as embossing.

The wrapping paper can be perforated to increase the air permeability, and in particular to increase the air permeability without considerably influencing the diffusion capacity. To this end, processes known from the prior art can be used such as mechanical perforation, electrostatic perforation, laser perforation or plasma perforation The wrapping paper can be printed, for example to provide an attractive outward appearance or to achieve other special effects, for example temperature-dependent color changes. In this regard, printing processes such as rotogravure printing, flexographic printing, offset printing or screen printing as well as spraying can be used. Regarding the printed pattern, no restrictions apply.

As the relevant technical properties for further processing, in particular the tensile strength and the elongation at break, do not differ from conventional wrapping papers for smoking articles—as will be shown by the exemplary embodiments following below—, any further process steps known in the current or future art can be carried out, insofar as they can also be carried out with conventional wrapping papers for smoking articles.

The wrapping papers according to the invention can be manufactured in accordance with processes that are known in the prior art. In particular, a pulp mixture can initially be suspended in water in one or more tanks and then all or a part of the pulp mixture can be refined in refining machines. After refining, further materials, for example filler materials, pigments, colorants or processing aids, for example retention aids, can be added. The wrapping paper can then be manufactured on a conventional paper machine, for example, a Fourdrinier paper machine. In this regard, an aqueous suspension of pulp fibers and optionally filler materials and other materials flows from a head box onto the wire of a paper machine and can be de-watered there under gravity or vacuum, whereupon a wrapping paper web is formed from the suspension. Next, the wrapping paper web passes through a press section, for example, in which the wrapping paper web is further de-watered by mechanical pressure between rolls and a press felt. Finally, the wrapping paper web can pass through a drying section, in which remaining water is removed by contact with heated drying rolls, hot air, infra-red radiation or microwaves, so that the wrapping paper web obtains its equilibrium moisture content of about 4-8% by weight of the finished wrapping paper. At the end of the paper machine, the wrapping paper web can be wound up.

There can be a film press or a size press in the drying section, in which substances can be applied to one or both sides of the wrapping paper to influence the surface of the wrapping papers. These substances can, for example, be pigments such as iron oxides, colorants, binders such as starch or carboxymethylcellulose, or filler materials such as calcium carbonate.

The further processing steps often comprise splitting a wide reel of the wrapping paper into narrower bobbins, whose width corresponds approximately to the perimeter of a smoking article to be manufactured therefrom, or an integer multiple thereof.

A smoking article according to the invention comprises a rod of tobacco or a different material, which generates smoke or an aerosol upon combustion or heating. According to the invention, this rod is wrapped by the wrapping material according to the invention in order to form a smoking article. Optionally, the smoking article can contain a filter which, for example, is connected to the wrapped rod by a tipping paper.

Preferably, the smoking article is a cigarette and particularly preferably a filter cigarette.

The smoking article can be manufactured manually, partially automatically or fully automatically using processes known from the prior art.

DESCRIPTION OF THE PREFERRED EMBODIMENTS

The following embodiments are intended to demonstrate the effect according to the invention.

Birch pulp and eucalyptus pulp were selected as a short-fiber pulp for the wrapping paper according to the invention. Calcium carbonate was used as a filler material.

TABLE 1

| | Pulp | | | | Degree of Refining | |
|---|---|---|---|---|---|---|
| No. | Birch refined % | unrefined % | Eucalyptus unrefined % | Filler Chalk % | Birch refined °SR | Mixture °SR |
| 1 | 40 | 60 | 0 | 0 | 30 | 22 |
| 2 | 40 | 60 | 0 | 0 | 40 | 25 |
| 3 | 20 | 80 | 0 | 0 | 40 | 21 |
| 4 | 80 | 0 | 20 | 36.5 | 36 | 33 |
| 5 | 80 | 0 | 20 | 39.3 | 52 | 46 |
| 6 | 80 | 0 | 20 | 43.0 | 71 | 60 |
| 7 | 80 | 0 | 20 | 0 | 36 | 33 |
| 8 | 80 | 0 | 20 | 0 | 52 | 46 |
| 9 | 80 | 0 | 20 | 0 | 71 | 60 |
| 10 | 80 | 0 | 20 | 30.5 | 79 | 57 |
| 11 | 80 | 0 | 20 | 0 | 79 | 57 |

Table 1 shows 11 different fiber/filler compositions, from which exemplary wrapping papers were manufactured. The fiber/filler composition is characterized by the fractions of refined birch pulp ("Birch refined" column), unrefined birch pulp ("Birch unrefined" column), unrefined eucalyptus pulp ("Eucalyptus unrefined" column) and filler materials ("Filler" column). The percentages for the refined and unrefined birch and eucalyptus pulp refer to the mass of the entire pulp mixture. The data for filler in percent, however, is with respect to the mass of the finished wrapping paper. In the columns headed "Degree of Refining", the degree of refining is given in accordance with ISO 5267-1:1999 in Schopper-Riegler (° SR). Therein the column "Birch refined" contains the values for the refined birch pulp only and the column "Mixture" contains the values for the entire pulp mixture without filler.

As can be seen in Table 1, for the compositions 1-3, mixtures of refined and unrefined birch pulp were used, while in the compositions 4-11, mixtures of refined birch pulp and unrefined eucalyptus pulp were used. The compositions 4-6 and 10 additionally contained precipitated calcium carbonate ("Chalk") as a filler material. The refined birch pulp was refined to degrees of refining between 30° SR and 79° SR. This already shows an essential advantage of the invention because, to refine the birch pulp, only about half the refining energy required for normal long-fiber pulp with respect to the mass was needed. This leads to substantial savings in refining energy.

In respect of the design of a wrapping paper, the compositions in Table 1 are the extreme points regarding the degree of refining, the filler content and the fractions of refined and unrefined short-fiber pulp, so that the skilled person will primarily select values between these extreme points when designing a wrapping paper for smoking articles according to the invention.

The fiber length distribution of the refined birch pulp was measured several times with a Fiber Tester Code 912, Type 987666, from the company Lorentzen & Wettre, in accordance with the instructions of the manufacturer of the measuring instrument, and a mean fiber length between 0.8 and 1.0 mm was obtained.

The refined birch pulp was mixed in an aqueous suspension with the unrefined birch pulp or the unrefined eucalyptus pulp according to the mixture ratios in Table 1. The filler was added to the suspension in the appropriate quantity and sheets were formed from the suspension on a laboratory sheet former and dried. In total, 14 wrapping papers were thus produced, whose data are given in Table 2.

Table 2 shows 14 exemplary embodiments according to the invention A-N (column "Example"), wherein for each embodiment, one of the fiber/filler suspensions of Table 1 was used. Column 2 of Table 2 shows the "Composition No.". The numbers provided therein correspond to the number in the column "No." of Table 1.

After a conditioning step for the sheets in accordance with ISO 187 at 23° C. and 50% relative humidity, different measurements were carried out on the sheets, the results of which are provided in Table 2.

TABLE 2

| Example | Composition No. | Basis Weight g/m$^2$ | Tensile Strength N/15 mm | Elongation at Break % | Air Permeability cm$^3$/(cm$^2$ · min · kPa) | Diffusion Capacity cm/s |
|---|---|---|---|---|---|---|
| A | 1 | 25 | 10 | | 7200 | 3.7 |
| B | 2 | 25 | 12 | | 4900 | 3.2 |
| C | 3 | 25 | 9 | | 7500 | 3.8 |
| D | 1 | 60 | | | 148 | 0.6 |
| E | 2 | 60 | | | 90 | 0.5 |
| F | 3 | 60 | | | 175 | 0.7 |
| G | 4 | 35 | 5 | 0.9 | 580 | 3.6 |
| H | 5 | 34 | 6 | 1.1 | 308 | 3.0 |
| I | 6 | 37 | 8 | 1.4 | 147 | 2.4 |

TABLE 2-continued

| Example | Composition No. | Basis Weight g/m² | Tensile Strength N/15 mm | Elongation at Break % | Air Permeability cm³/(cm² · min · kPa) | Diffusion Capacity cm/s |
|---|---|---|---|---|---|---|
| J | 7 | 23 | 20 | 2.5 | 1240 | 2.3 |
| K | 8 | 23 | 21 | 2.5 | 272 | 1.1 |
| L | 9 | 23 | 24 | 2.4 | 75 | 0.4 |
| M | 10 | 37 | 10 | 1.5 | 203 | 2.0 |
| N | 11 | 25 | 25 | 2.8 | 142 | 0.6 |

The basis weight was measured in accordance with ISO 536:2012; the results are provided in the column headed "Basis Weight". The tensile strength and elongation at break were measured in accordance with ISO 1924-2:2008 and are provided in the columns "Tensile Strength" and "Elongation at Break". The air permeability was measured in accordance with ISO 2965:2009 and is provided in the column "Air Permeability". Finally, the diffusion capacity was also measured in accordance with CORESTA Recommended Method No. 77 (April 2014) and the values are provided in the column "Diffusion Capacity".

From examples A-C it can be seen that even at a basis weight of 25 g/m², a sufficient tensile strength of at least 9 N/15 mm can be achieved so that the wrapping paper can be processed automatically into a smoking article without problems. The air permeabilities of examples A-C of 4900 cm³/(cm²·min·kPa) to 7500 cm³/(cm²·min·kPa) are very high for common wrapping papers for smoking articles; by increasing the basis weight, the refining energy or the fraction of refined birch pulp, but also by selecting a different short-fiber pulp, the air permeability can be reduced if needed. The diffusion capacities of the wrapping papers from examples A-C are also high, which can reduce the carbon monoxide content in the smoke of a smoking article manufactured therefrom.

Examples D-F use the same fiber/filler suspensions 1-3 as the examples A-C, but at a considerably higher basis weight of 60 g/m². Thus, the air permeability, with values of 90 cm³/(cm²·min·kPa) to 175 cm³/(cm²·min·kPa) is also substantially lower than in the examples A-C. The diffusion capacities of the wrapping papers of the examples D-F of 0.5 cm/s to 0.7 cm/s are within the usual range for wrapping papers for smoking articles. The tensile strength was not measured because the composition of the wrapping papers of the examples D-F is the same as for the examples A-C and because of the higher basis weight, a substantial increase in tensile strength would be expected, so that the values will in any case be substantially above 12 N/15 mm, which is the highest value for examples A-C.

The wrapping papers of examples G-N contained refined birch pulp and unrefined eucalyptus pulp and examples G, H, I and M also contained filler material. The basis weights are within a normal range for conventional wrapping papers for smoking articles of 23 g/m² to 37 g/m². The examples G and H, with a tensile strength of 5 N/15 mm and 6 N/15 mm respectively, are just within an acceptable range. From these examples, it can be seen that by refining the birch pulp a little and using a high fraction of filler material of 36.5% (example G) and 39.3% (example H), the tensile strength of the wrapping paper is reduced. For example I, however, the filler content is even higher at 43%, but the birch pulp is also refined to a higher degree of refining of 71° SR. Thus, a tensile strength of 8 N/15 mm is achieved, which may be sufficient for, automatic processing of the wrapping paper, but is in any case sufficient for a wrapping paper for manually produced smoking articles.

For examples G-N the elongation at break was also measured. Values from 0.9% to 2.8% were found, which is in any case sufficient for automatic processing of the wrapping paper.

The air permeability of the wrapping paper of examples G-N is in the range from 75 cm³/(cm²·min·kPa) to 1240 cm³/(cm²·min·kPa), and fully covers the normal range of wrapping papers for smoking articles. The same applies to the diffusion capacities of examples G-N, which are between 0.4 cm/s and 3.6 cm/s.

The wrapping papers described can be used to manufacture a smoking article, for example by using the wrapping papers to wrap a tobacco rod or a different material which releases an aerosol upon heating or combustion. Because all essential properties of the wrapping paper of the examples A-N lie in a typical range for a wrapping paper for smoking articles, the manufacturing processes for manufacturing smoking articles do not differ from those known from the prior art. For this reason, the processes for manufacturing corresponding smoking articles have not been described in the present description.

Overall, it can be seen from the exemplary embodiments A-N that, contrary to expectations, wrapping papers for smoking articles with the typical properties of such wrapping papers can be manufactured by primarily or exclusively using short-fiber pulp. In contrast to the prior art, this is possible with substantial savings in costs for energy and raw materials.

The invention claimed is:

1. Wrapping paper for smoking articles with a basis weight of at least 10 g/m² and at most 70 g/m², comprising:

a mixture of pulp fibers, wherein the mixture of pulp fibers is formed by at least 90% of short-fiber pulp fibers with respect to the mass of the pulp fibers in the pulp mixture, or by at least 95% short-fiber pulp fibers with respect to the number of pulp fibers, wherein said short-fiber pulp is at least primarily sourced from deciduous trees, wherein the fibers of the pulp mixture have a mean length of at least 0.1 mm and of at most 1.5 mm, and wherein at least 10% of the short-fiber pulp fibers, with respect to the mass or number of the pulp fibers of the pulp mixture, are refined, wherein more than 50% of the surface area of the wrapping paper has an air permeability of at least 30 cm³/(cm²·min·kPa), and wherein the wrapping paper contains at least one burn additive, wherein said wrapping paper has a tensile strength in the machine direction in accordance with ISO 1924-2:2008 of at least 10 N/15 mm and at most 25 N/15 mm, an elongation at break in the machine direction in accordance with ISO 1924-2:2008 of at least 0.9% and at most 3.0%, and a diffusion capacity in untreated areas that is at least 0.1 cm/s and at most 4.0 cm/s.

2. Wrapping paper according to claim 1, wherein the wrapping paper has coated areas which make up less than 50% of the surface area of the wrapping paper.

3. Wrapping paper according to claim 1, wherein the fraction of the short-fiber pulp with respect to the mass of the pulp fibers in the pulp mixture is at least 95%.

4. Wrapping paper according to claim 1, wherein the fraction of refined short-fiber pulp fibers, with respect to the mass of the entire pulp fibers, is at least 30% and at most 100%, or with respect to the total number of pulp fibers, is at least 35% and at most 100%.

5. Wrapping paper according to claim 1, wherein the degree of refining of the refined short-fiber pulp in accordance with ISO 5267-1:1999 is at least 20° SR and at most 80° SR.

6. Wrapping paper according to claim 1, wherein the degree of refining of the pulp mixture in the wrapping paper is at least 30° SR and at most 70° SR.

7. Wrapping paper according to claim 1, wherein the short-fiber pulp is at least primarily sourced from one or more of the following trees:

birch, beech, eucalyptus, poplar or aspen.

8. Wrapping paper according to claim 1, with a basis weight of at least 25 $g/m^2$ and at most 40 $g/m^2$.

9. Wrapping paper according to claim 1, further comprising one or more filler materials, wherein at least a fraction of the one or more filler materials is selected from a group which consists of calcium carbonate, magnesium oxide, magnesium hydroxide, magnesium carbonate and aluminum hydroxide.

10. Wrapping paper according to claim 1, wherein the wrapping paper has a filler content of at most 45% by weight and at least 10% by weight, each referred to the weight of the wrapping paper.

11. Wrapping paper according to claim 1, further comprising:

at least a burn additive selected from the group consisting of citrates, malates, tartrates, acetates, succinates, fumarates, gluconates, glycolates, lactates, oxalates, salicylates, α-hydroxy caprylates, phosphates and hydrogen carbonates.

12. Wrapping paper according to claim 11, wherein the burn additive content is at least 0.5% by weight, and at most 7.0% by weight.

13. Wrapping paper according to claim 1, with an air permeability in untreated areas that is at least 50 $cm^3/(cm^2 \cdot min \cdot kPa)$, and at most 5000 $cm^3/(cm^2 \cdot min \cdot kPa)$.

14. Wrapping paper according to claim 1, which further has areas of reduced diffusion capacity which serve to self-extinguish a smoking article manufactured therefrom.

15. Wrapping paper according to claim 1, which further is artificially perforated at least in sections.

16. Smoking article comprising a rod of tobacco or a different material, which forms smoke or an aerosol upon combustion or heating, wherein this rod is wrapped with a wrapping paper according to claim 1.

17. Smoking article according to claim 16, which comprises a filter which is connected with the wrapped rod via a tipping paper.

18. Wrapping paper according to claim 11, wherein said burn additive is selected from the group consisting of trisodium citrate and tripotassium citrate.

19. Wrapping paper according to claim 11, wherein the burn additive content is at least 0.7% by weight and at most 3.0% by weight.

20. Wrapping paper according to claim 13, with an air permeability in untreated areas that is at least 70 $cm^3/(cm^2 \cdot min \cdot kPa)$ and at most 500 $cm^3/(cm^2 \cdot min \cdot kPa)$.

* * * * *